US006848685B2

(12) United States Patent
Katsuyama

(10) Patent No.: US 6,848,685 B2
(45) Date of Patent: Feb. 1, 2005

(54) PRINTER

(75) Inventor: Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 261 days.

(21) Appl. No.: 10/244,529

(22) Filed: Sep. 17, 2002

(65) Prior Publication Data

US 2003/0052956 A1 Mar. 20, 2003

(30) Foreign Application Priority Data

Sep. 17, 2001 (JP) ..... 2001-282195

(51) Int. Cl.[7] ..... B41J 29/13

(52) U.S. Cl. ..... 271/162; 271/213; 271/3.14; 347/108

(58) Field of Search ..... 271/3.14, 162, 271/213; 399/108, 110; 400/625; 347/108, 170, 222, 245, 263

(56) References Cited

U.S. PATENT DOCUMENTS

| | | | | | |
|---|---|---|---|---|---|
| 13,335 | A | * | 7/1855 | Davis | 101/278 |
| 17,449 | A | * | 6/1857 | Potter, Jr. | 101/278 |
| 1,075,697 | A | * | 10/1913 | Cox | 271/3.14 |
| 5,082,269 | A | * | 1/1992 | Hirayama et al. | 271/65 |
| 5,150,890 | A | * | 9/1992 | Kunikawa et al. | 271/9.05 |
| RE35,341 | E | * | 10/1996 | Kikuchi et al. | 271/3.14 |
| 6,142,461 | A | * | 11/2000 | Asao et al. | 270/58.09 |
| 6,304,739 | B1 | | 10/2001 | Katsuyama et al. | |
| 6,382,617 | B1 | * | 5/2002 | Yen et al. | 271/3.14 |
| 6,494,633 | B1 | * | 12/2002 | Crosby et al. | 400/668 |
| 6,568,865 | B1 | * | 5/2003 | Fujioka et al. | 400/647.1 |
| 6,582,139 | B2 | * | 6/2003 | Abe et al. | 400/599.1 |
| 6,595,514 | B2 | * | 7/2003 | Takahashi | 271/162 |

FOREIGN PATENT DOCUMENTS

| | | | | |
|---|---|---|---|---|
| JP | 05-077507 | | 3/1993 | |
| JP | 08-073097 | | 3/1996 | |
| JP | 09-301602 | | 11/1997 | |
| JP | 10119388 | A * | 5/1998 | B41J/29/13 |

* cited by examiner

*Primary Examiner*—Patrick Mackey
(74) *Attorney, Agent, or Firm*—Oblon, Spivak, McClelland, Maier & Neustadt, P.C.

(57) ABSTRACT

A printer of the present invention includes a first and a second tray each being movable between a full-closed position and an open position. When the operator moves the first tray in the opening direction, the first tray forces the second tray located on the locus of movement of the first tray in the opening direction, uncovering a first and a second opening at the same time. When the operator moves the second tray in the closing direction, the second tray forces the first tray located on the locus of movement of the first tray in the closing direction, covering the two openings at the same time. The operator can therefore move the two trays by a single action.

40 Claims, 13 Drawing Sheets

PRINTER

BACKGROUND OF THE INVENTION

1. Field of the Invention

The present invention relates to a printer for personal use to be set on, e.g., a desk.

2. Description of the Background Art

A printer of the type including a housing formed with a sheet inlet and a sheet outlet and a printer section arranged in the housing is conventional. In this type of printer, a sheet path provides communication between the sheet inlet and the sheet outlet via the printer section, so that the printer section can print an image on a recording medium being conveyed along the sheet path.

When the recording medium is implemented as a sheet, it is a common practice to locate a sheet feed tray, a print tray or similar member for positioning the sheet or the resulting print in the vicinity of a sheet inlet or a sheet outlet. Such a member can position a plurality of sheets in the vicinity of the sheet inlet or the sheet outlet, so that images can be sequentially printed on a plurality of sheets without interruption.

For example, in a printer including a sheet inlet and a sheet outlet both of which are mounted on one side of a housing, a sheet feed tray and a print tray both are mounted on the same side of the housing as the sheet inlet and sheet outlet. The problem with this configuration is that the sheet feed tray and print tray both protrude from the housing and therefore occupy an extra space in addition to a space occupied by the housing. This is more serious when the sheet feed tray and print tray are respectively mounted on the front and rear of the housing.

In light of the above, there has been proposed a printer in which a sheet feed tray and a print tray are respectively mounted on the front and rear of a housing, but one or both of them are foldable. In this case, the sheet feed tray and/or the print tray is folded when the printer is out of operation or unfolded when it is in operation. Although this kind of scheme saves space, it forces the operator to open the sheet feed tray and print tray one by one, resulting in troublesome work. Further, the sheet feed tray and print tray each need an exclusive extra space when unfolded.

The printer of the type having the sheet feed tray and print tray mounted at one side thereof needs the extra space only at one side. However, the sheet feed tray and print tray always protruding from the housing wastefully occupy the space when the printer is out of operation. Moreover, dust and other impurities are apt to enter the housing via the sheet inlet and sheet outlet, which are always open.

Technologies relating to the present invention are disclosed in, e.g., Japanese Patent Laid-Open Publication Nos. 5-77507, 8-73097 and 9-301602.

SUMMARY OF THE INVENTION

It is an object of the present invention to provide a printer facilitating manual work for opening and closing a sheet inlet and a sheet outlet.

It is another object of the present invention to provide a printer capable of saving space.

It is a further object of the present invention to provide a printer capable of obstructing the entry of dust and other impurities in a housing.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
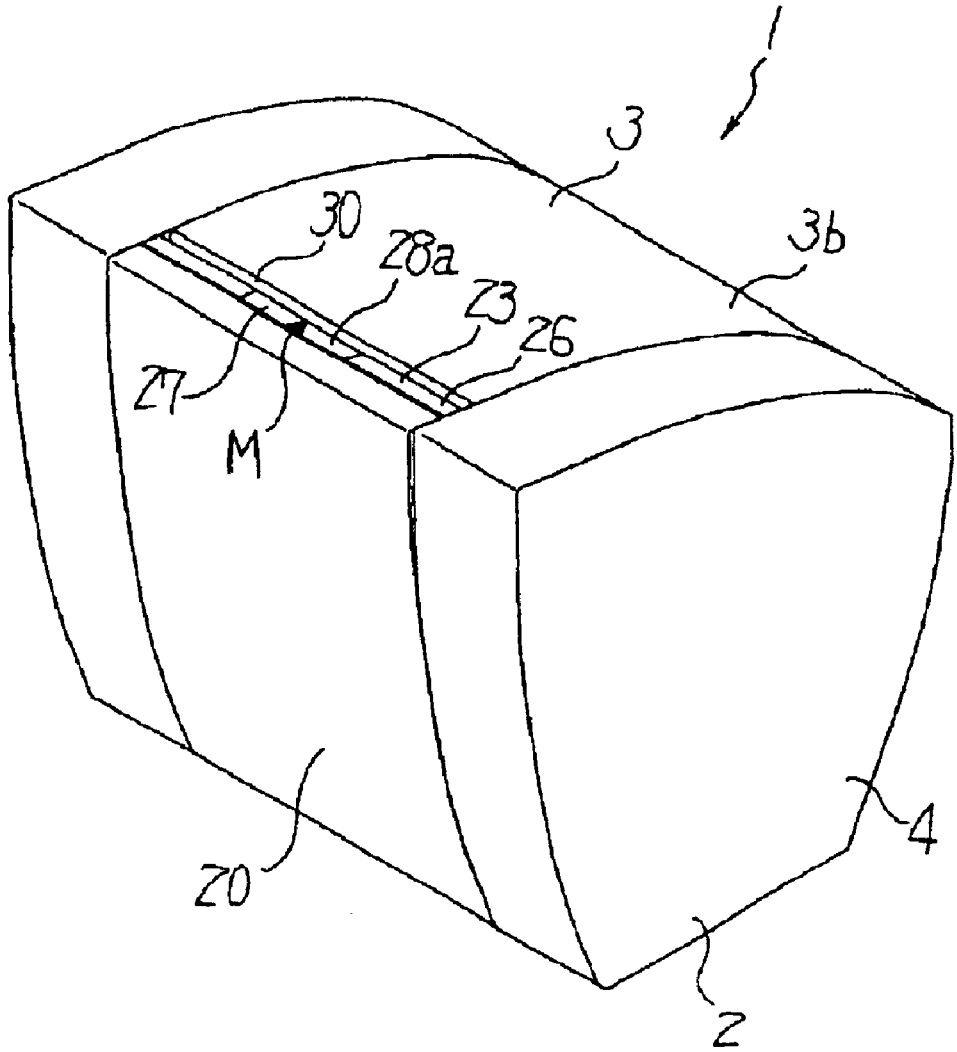
FIG. 1 is an isometric view showing a first embodiment of the ink jet printer in accordance with the present invention.

Preferred embodiments of the printer in accordance with the present invention will be described hereinafter with reference to the drawings. In the illustrative embodiments, the printer is implemented as an ink jet printer configured to perform printing in accordance with print data received from a personal computer by way of example. In the figures, identical reference numerals designate identical structural elements.

First Embodiment

Referring to FIGS. 1 through 4, an ink jet printer embodying the present invention is shown. As shown, the ink jet printer, generally 1, includes a housing or body 2 made up of a main housing 3 and side covers 4 mounted on both sides of the main housing 3 in the main scanning direction (direction perpendicular to the sheet surface of FIG. 3). The main housing 3 is sized smaller than the side covers 4 in the subscanning direction (right-and-left direction in FIG. 3), so that a hollow 5 is formed at the front of the housing 2. The hollow 5 has a size corresponding to a difference in size between the main housing 3 and the side covers 4 and extends inward front the front (left-hand side of FIG. 3) of the housing 2. The hollow 5 is sized larger than the sheet size available with the printer 1 in the main scanning direction.

In the illustrative embodiment, the front end of the main housing 3, which forms part of the hollow 5, implements an upright wall 3*a*. The upright wall 3*a* is formed with a sheet outlet or first opening 6 and a sheet inlet or second opening 7 both of which are elongate in the horizontal direction. The sheet outlet 6 provides communication between the inside and the outside of the housing 2. The sheet inlet 7 is positioned below the sheet outlet 6. The sheet outlet 6 and sheet inlet 7 each are sized larger than the sheet size available with the printer 1 in the main scanning direction.

Arranged inside the printer are a printer section 8 for printing images on sheets and a generally U-shaped sheet path 9 providing communication between the sheet inlet 7 and sheet outlet 6 via the printer section 8. Guides 10 are positioned on the sheet path 9 for limiting a position where a sheet is to be conveyed.

The printer section 8, which is conventional, will be briefly described hereinafter. The printer section 8 includes a carriage shaft 11 extending in the main scanning direction and a carriage 12 slidable on and along the carriage shaft 11 in the main scanning direction. The nozzle of an ink jet head, not shown, is located on the carriage 12 at a position where it faces the sheet path 9. An ink cartridge 13 storing ink therein is removably mounted on the carriage 12. During printing, the ink fed from the ink cartridge 13 is jetted toward a sheet via the nozzle. The operator of the printer 1 can replace the ink cartridge 13 from above the main housing 3 by opening a top cover 3*b*, which usually closes the top of the main housing 3. A carriage motor, not shown, is disposed in the housing 2 for causing the carriage 12 to move back and forth in the main scanning direction.

In the printer section 8, an endless belt 15 is passed over a pair of rollers 14 and faces the carriage 12 with the intermediary of the sheet path 9. A motor, not shown, causes one of the rollers 14 to rotate and move the belt 15. The other roller 14 rotates by being driven by the belt 15. The rollers 14 and belt 15 constitute part of a conveying mechanism.

A sheet feeding mechanism 16 is positioned on the sheet path 9 in the vicinity of the sheet inlet 7 and includes a pickup roller 17 and a sheet support member 18 positioned below the pickup roller 17. Forming part of conveying means, the pickup roller 17 is positioned such that its circumferential surface interferes with the sheet path 9. A motor, not shown, disposed in the housing 2 causes the pickup roller 17 to rotate in a direction indicated by an arrow in FIG. 3.

One end 18*a* of the sheet support member 18 is mounted on a shaft 19 affixed to the housing 2, so that the other end 18*b* of the sheet support member 18 is angularly movable in the up-and-down direction about the end 18*a*. A mechanism, not shown, selectively locates the end 18*b* of the sheet support member 18 at a stand-by position indicated by a solid line in FIG. 4 or a feed position indicated by a phantom line in FIG. 4. When the sheet support member 18 is located at the feed position, the top of a sheet stack set on a surface 18*c* abuts against the pickup roller 17.

A sheet feed tray 20 is mounted on the housing 2 and has a surface 20*a* contiguous with the surface 18*c* of the sheet support member 18. Stubs or second support shafts 21 extend out from opposite sides of the sheet feed tray 20 in the main scanning direction. Bearings 22 are mounted on the walls of the housing 2 delimiting the hollow 5 and are positioned below the sheet inlet 7. The stubs 21 are respectively rotatably supported by the bearings 22, so that the sheet feed tray 20 is angularly movable about the stubs 21.

A print tray 23 is mounted on the housing 2 and has a surface 23*a* contiguous with the lower edge of the sheet outlet 6. Stubs or first support shafts 24 extend out from opposite sides of the print tray 20 in the main scanning direction. Bearings 25 are mounted on the walls of the housing 2 delimiting the hollow 5 and are positioned above the sheet inlet 7, but below the sheet outlet 6, and inward of the stubs 22. The subs 24 are respectively rotatably supported by the bearings 25, so that the print tray 23 is angularly movable about the stubs 24.

Figure 2:
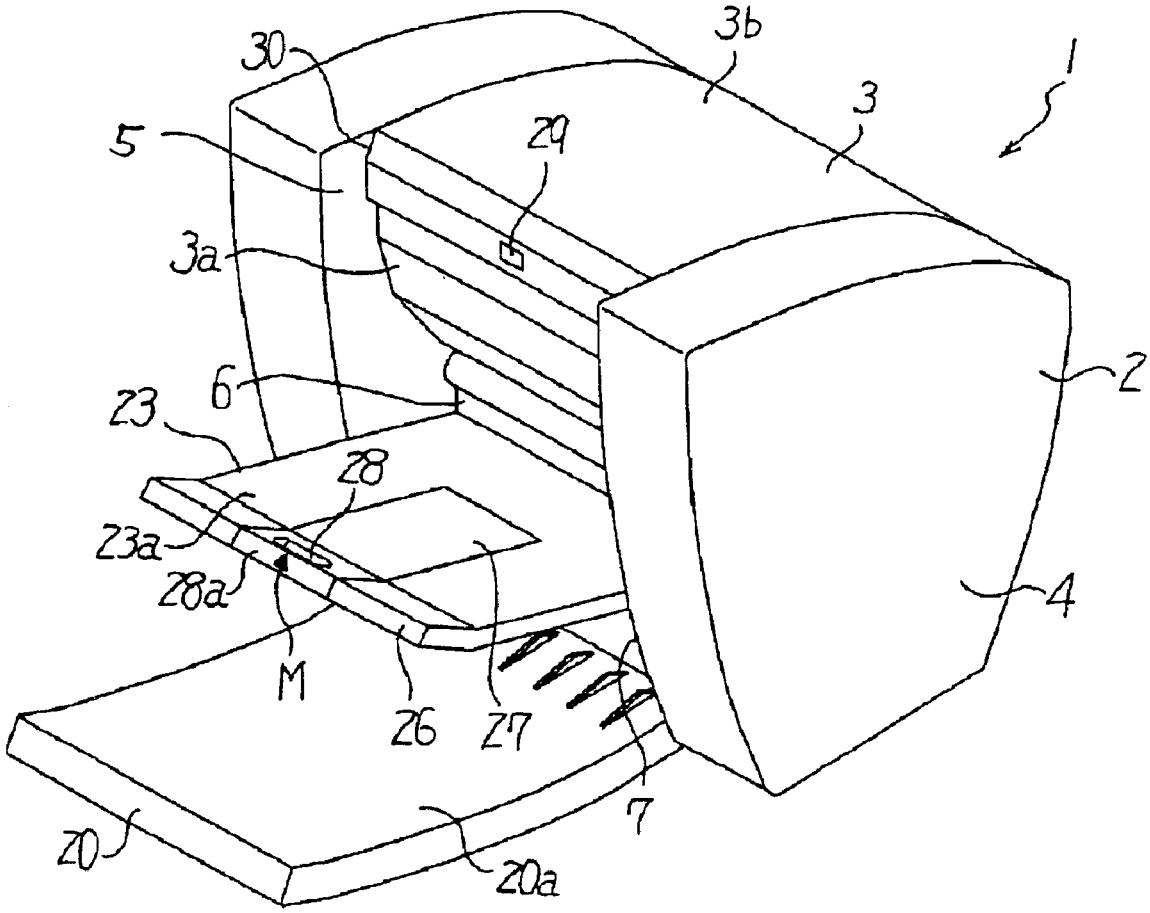
FIG. 2 is an isometric view showing the first embodiment in a different condition.
Figure 3:
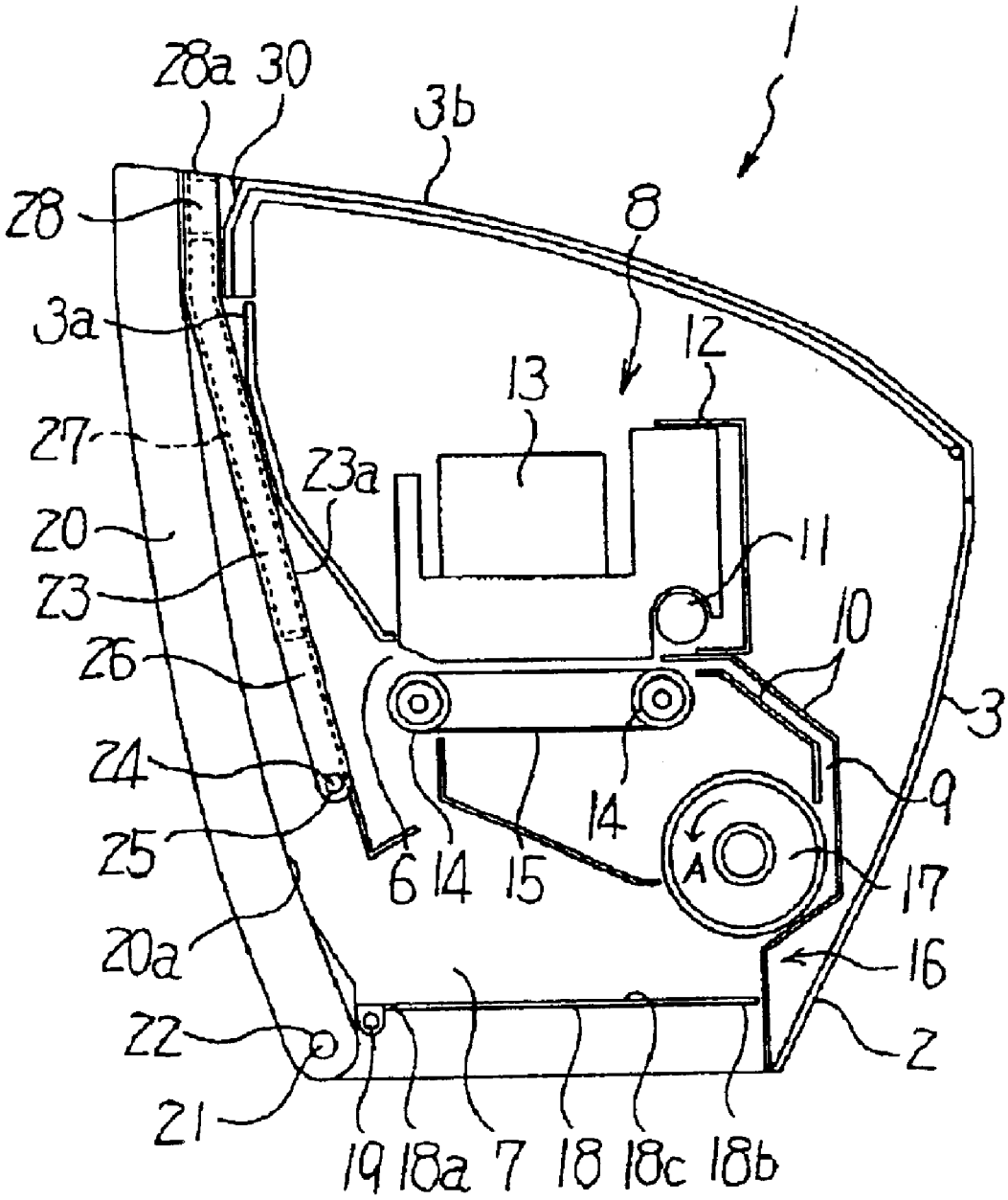
FIG. 3 is a vertical section corresponding to FIG. 1.
Figure 4:
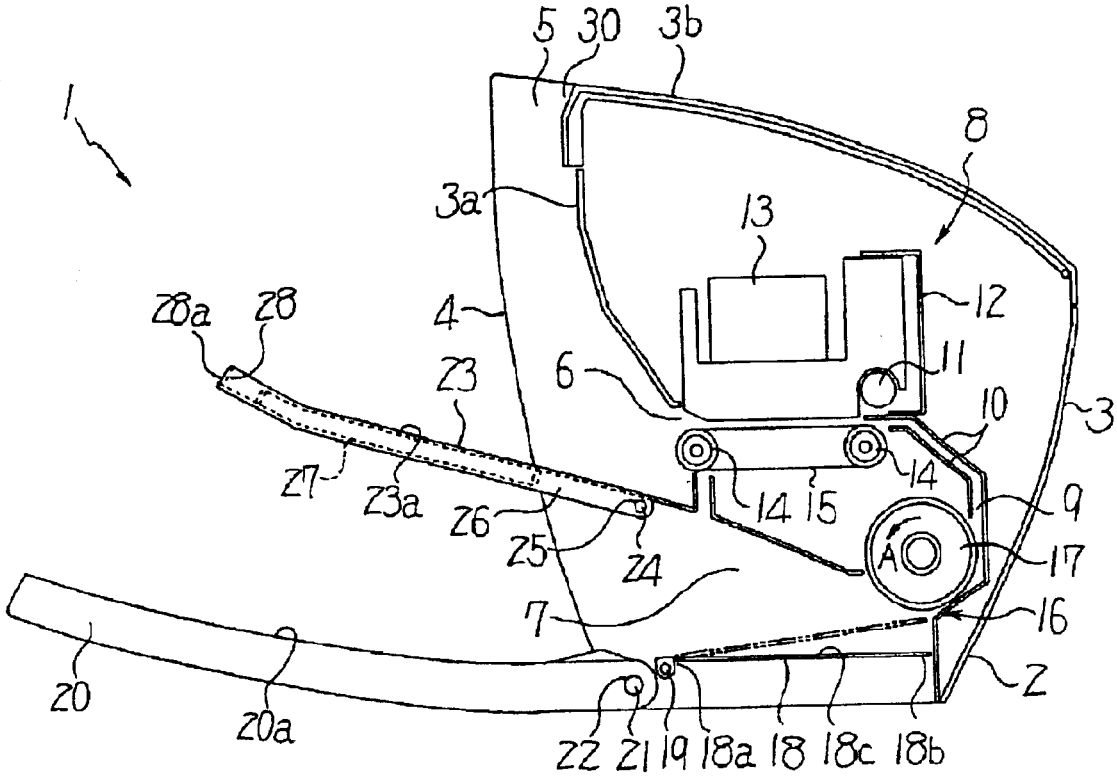
FIG. 4 is a vertical section corresponding to FIG. 2.

In the illustrative embodiment, the position of the sheet feed tray 20 shown in FIGS. 1 and 3 and the position of the same shown in FIGS. 2 and 4 will be referred to as a full-closed position and a full-open position, respectively. This is also true with the print tray 23. In the full-closed position, the sheet feed tray 20 and print tray 23 stand upright in parallel to each other while covering the upright wall 3*a* because the bearings 25 are positioned inward of the bearings 22. Further, as shown in FIGS. 1 and 3, in the full-closed position, the sheet feed tray 20 and print tray 23 are fully received in the hollow 5 without protruding from the housing 2.

In the illustrative embodiment, the print tray 23 is made up of a main tray 26 angularly movable about the stubs 24 and a subtray 27 mounted on the intermediate portion of main tray 26 in the main scanning direction. The subtray 27 is slidable on the main tray 26 away from the stubs 24. A grip 28 is positioned at the edge of the subtray 27 remote from the stubs 24. The grip 28 is implemented as an elongate slot formed in the surface 23*a* and so sized to allow the operator to grip the subtray 27.

The upper end portion of the main housing 3 expected to face the grip 28 is partly removed to form a notch 30, so that the operator can easily hold the grip 28 even when the print tray 2 is held in the full-closed position.

A mark M indicative of the position of the grip 28 is provided on the end face 28*a* of the print tray 23 that faces the outside in the full-closed position. The mark M allows the operator to easily see the position of the grip 28 from the outside of the housing 2 even when the print tray 23 is held in the full-closed position. Of course, the mark M is only illustrative and may be replaced with any other suitable implementation that allows the operator to see the position of the grip 28 at a glance. For example, the above part of the end face 28*a* may be painted in a color different from the color of the housing 2 surrounding it.

A microsensor 29 is mounted on the housing 2 and turned on in the full-closed position of the print tray 23 or turned off in the other position of the same (open position hereinafter).

A controller, not shown, controls the various sections of the printer 1. For example, when the microsensor 29 is turned on, the controller interrupts power supply to the various sections of the printer 1 for thereby making the printer 1 inoperative. When the microsensor 29 is turned off due to the open position of the print tray 23, the controller starts feeding power to the above sections for thereby making the printer 1 operative. In the operative condition of the printer 1, the controller controls the various motors stated earlier while feeding a current to the ink jet head.

Figure 5:
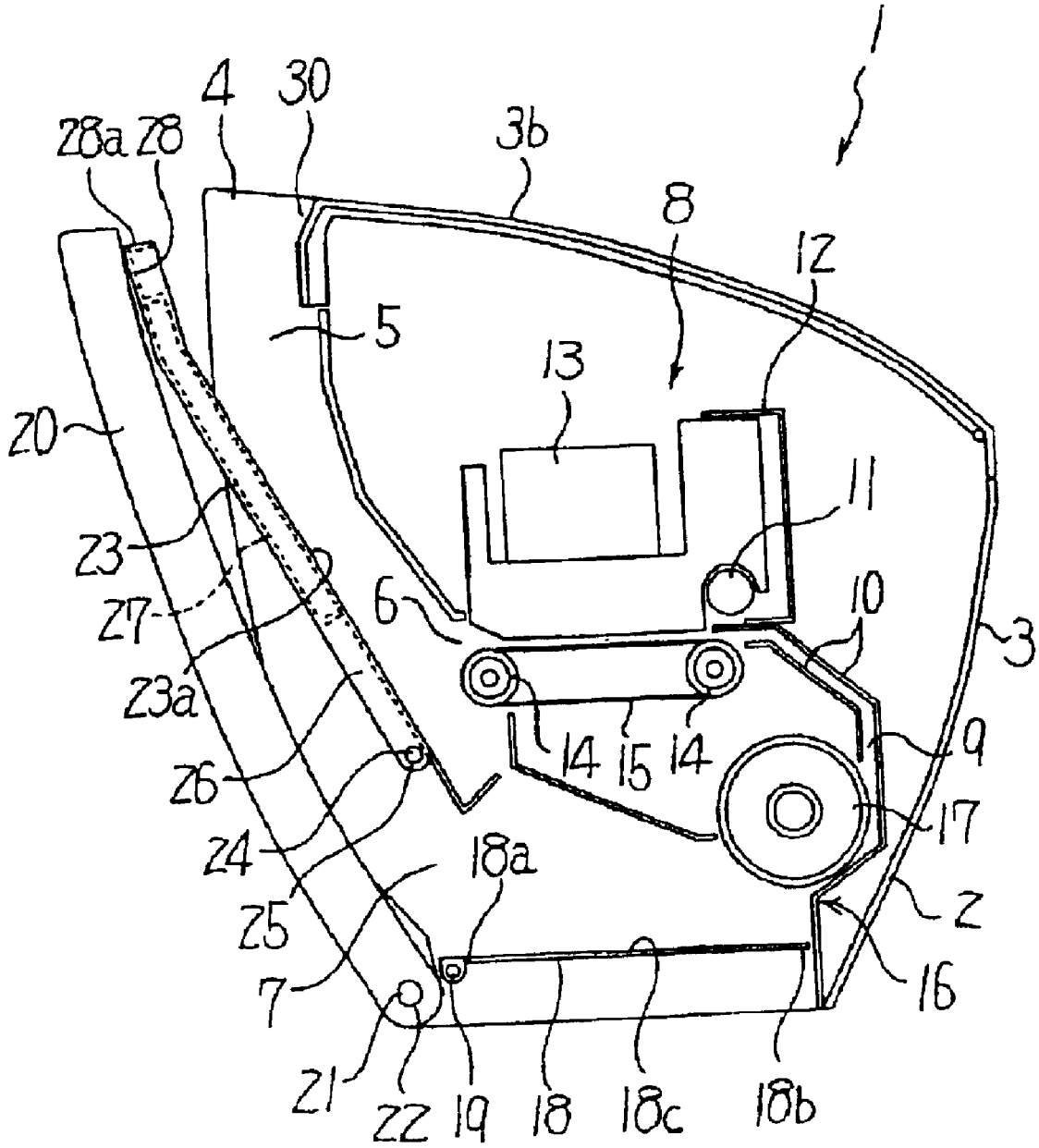
FIG. 5 is a vertical section showing the first embodiment in another condition.

In operation, the operator opens the sheet feed tray 20 and print tray 23 in order to uncover the sheet inlet 7 and sheet outlet 6. As FIG. 3 indicates, the locus along which the sheet feed tray 20 moves about the stubs 21 and the locus along which the print tray 23 moves about the stubs 24 partly overlap each other. This, coupled with the fact that the sheet feed tray 20 precedes the print tray 23 in the opening direction, causes the tray 23 being opened to force the tray 20 in the opening direction, as shown in FIG. 5. The operator can therefore easily turn both of the sheet feed tray 20 and print tray 23 downward to uncover the sheet inlet 7 and sheet outlet 6 by simply turning the tray 23 in the opening direction.

In the illustrative embodiment, the condition wherein the inside and outside of the housing 2 are communicated to each other via the sheet inlet 7 will be referred to as a condition wherein the sheet inlet 7 is open. This is also true with the sheet outlet 6.

As shown in FIG. 4, the sheet feed tray 20 and print tray 23 held in their full-open positions overlap each other in the up-and-down direction. Therefore, a space occupied by the printer 1 does not increase by more than the area of the sheet feed tray 20 even when the two trays 6 and 7 are fully opened, i.e., in the event of printing.

When the print tray 23 is moved from the full-closed position to the full-open position, the output of the microsensor 29 changes. The controller determines whether or not the print tray 23 is brought to the full-open position by referencing the output of the microsensor 29. In this sense, the controller plays the role of deciding means. On determining that the print tray 23 has reached the full-open position, the controller starts feeding power to the various sections of the printer 1 and then waits for a print command. In this respect, the controller plays the role of power feeding means.

When the sheet inlet 7 is uncovered, the surface 20*a* of the sheet feed tray 20 and surface 18*c* of the sheet support member 18 are exposed to the outside while being contiguous with each other. In this condition, the operator can easily stack sheets on the sheet feed tray 20 such that the leading edge of the sheet stack is positioned on the end 18*b* of the sheet support member 18. Subsequently, the mechanism mentioned earlier raises the sheet feed member 18 to the feed position where the top of the sheet stack abuts against the pickup roller 17. The motor causes the pickup roller 17 contacting the sheet stack to rotate and pay out the top sheet to the sheet path 9.

The guides 10 guide the sheet being conveyed along the sheet path 9 by the pickup roller 17. The sheet is therefore preventing from jamming the sheet path 9 despite that the sheet path 9 is generally U-shaped in order to provide communication between the sheet inlet 7 and sheet outlet 6, which are positioned at the front end of the housing 2.

In the printer section 8, as soon as the sheet being conveyed along the sheet path 9 faces the nozzle of the ink jet head, the carriage motor causes the carriage 12 to move back and forth in accordance with print data received from, e.g., a personal computer not shown. The ink fed from the ink cartridge 13 is jetted from the nozzle for thereby printing an image on the sheet. The resulting print is conveyed by the belt 15 to the surface 23*a* of the print tray 23.

The stubs 25 of the print tray 23 are positioned above the sheet inlet 7, as stated earlier. Therefore, to prevent the print tray 23 from protruding from the housing 2 in the full-closed position, it is necessary to make the print tray 23 smaller in size in the subscanning direction than the sheet feed tray 20 by a dimension corresponding to the distance between the stubs 21 and the stubs 24. Such a size of the print tray 23, however, is likely to be short for certain sheets and cause the sheets to drop from the surface 23*a*.

In light of the above, the print tray 23 is made up of the main tray 26 and subtray 27, as stated previously. The subtray 27 is slidable away from the stubs 24 in order to increase the dimension of the print tray 23 in the subscanning direction in accordance with the sheet size. It follows that even when the size of the print tray 23 in the subscanning direction is reduced for the purpose described above, sheets sequentially driven out via the sheet outlet 6 can be surely stacked on the surface 23*a* without dropping. It is noteworthy that the operator holding the grip 28 of the subtray 27 can slide it away from the stubs 24 immediately after fully opening the print tray 23.

In a conventional printer of the type having the sheet inlet 7 and sheet outlet 6 at one side thereof, the sheet inlet 7 and sheet outlet 6 both are always open even when the printer is not used, so that dust and other impurities are apt to enter the housing 2 via the sheet inlet 7 and sheet outlet 7 and lower print quality. By contrast, in the illustrative embodiment, when the printer 1 is not operated, the sheet feed tray 20 and print tray 23 rotatable about the stubs 21 and 24, respectively, close the sheet inlet 7 and sheet outlet 6, respectively.

The locus along which the print tray 23 moves about the stubs 24 and the locus along which the sheet feed tray 20 moves about the stubs 21 partly overlap each other, as stated earlier. This, coupled with the fact that the print tray 23 precedes the print tray 20 in the closing direction, causes the tray 20 being closed to force the tray 23 in the closing direction, as shown in FIG. 5. Therefore, when the printer 1 is not operated-, the operator can easily turn both of the sheet feed tray 20 and print tray 23 upward to close the sheet inlet 7 and sheet outlet 6 by simply turning the tray 20 in the closing direction.

When the print tray 23 is moved from the full-open position to the full-closed position, the output of the microsensor 29 changes. The controller determines whether or not the print tray 23 is brought to the full-closed position by referencing the output of the microsensor 29. In this sense, too, the controller plays the role of the deciding means. On determining that the print tray 23 has reached the full-closed position, the controller stops feeding power to the various sections of the printer 1 and then shuts off power supply to the printer 1. In this respect, the controller plays the role of power shutting means. This prevents the printer 1 from wastefully consuming power even when the operator forgets to switch off the printer 1.

When the sheet feed tray 20 and print tray 23 are held in their full-closed positions, the printer 1 occupies only a space necessary for the housing 2 in the front-and-rear direction and therefore contributes to space saving.

It is to be noted that the microsensor 29 constituting the deciding means in combination with the controller may, of course, be replaced with, e.g., a reflection type optical sensor so long as it is responsive to the full-closed position of the print tray 23.

In the illustrative embodiment, power supply to the printer 1 is selectively turned on or turned off in accordance with the output of the microsensor 29, which is responsive to the full-closed position of the print tray 23. Alternatively, the printer 1 maybe connected to, e.g., a personal computer by a USB (Universal Serial Bus) cable, in which case power supply to the printer 1 will be set up simultaneously with the transmission of print data. This fully shuts off power supply to the printer 1 when the printer 1 is not operated, thereby further enhancing power saving.

Further, the sheet feed tray 20 and print tray 23 held in the full-closed positions are fully received in the hollow 5 and do not protrude from the housing 2. The trays 20 and 23 are therefore protected from damage ascribable to a shock or an impact that may be accidentally applied from the outside of the printer 1.

Second Embodiment

Figure 6B:
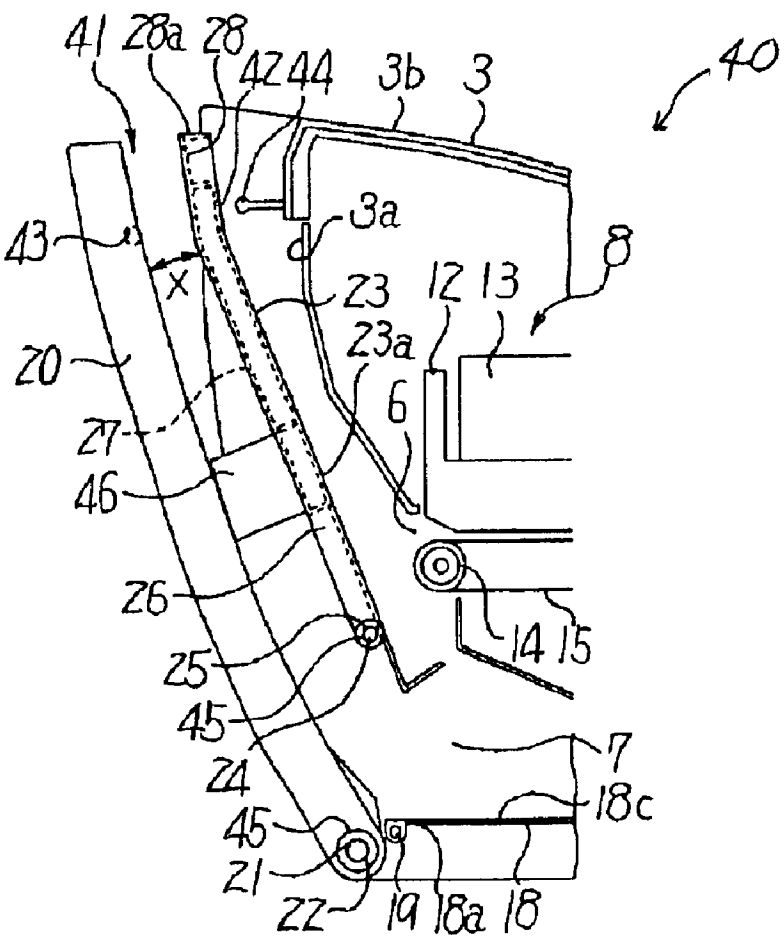
FIGS. 6A and 6B are vertical sections showing a second embodiment of the present invention.
Figure 6A:
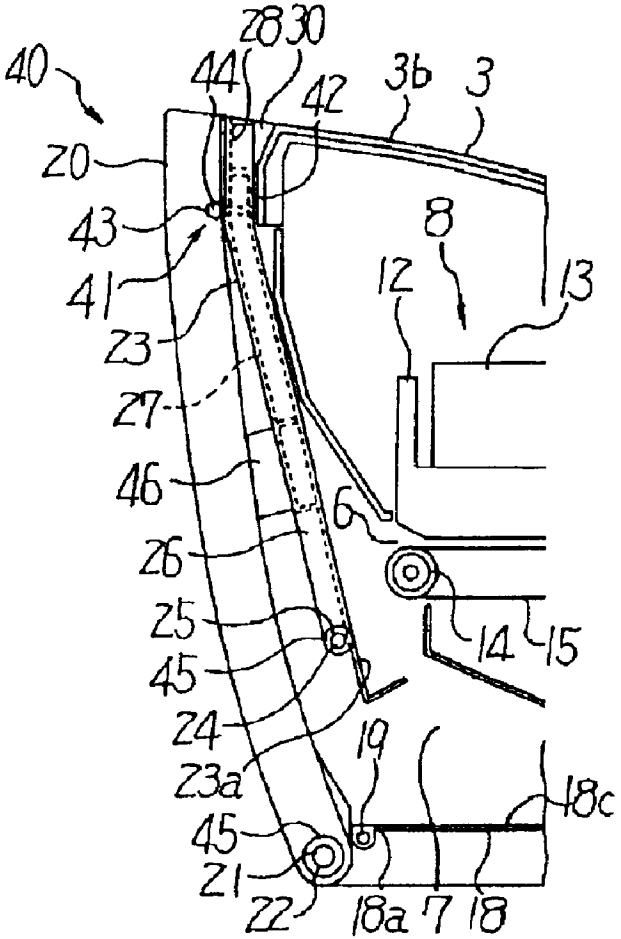

A second embodiment of the ink jet printer in accordance with the present invention will be described hereinafter with reference to FIGS. 6A and 6B. As shown, the printer, generally 40, includes a locking mechanism 41 for locking the sheet feed tray 20 and print tray 23 in the full-closed positions. The locking mechanism 41 is made up of a hole 42 formed throughout the print tray 23, a recess 43 formed in the sheet feed tray 20, and a lug 44 protruding from the front end of the top cover 3*b*. The lug 44 is configured to mate with the recess 43 via the hole 42.

The stubs 21 of the sheet feed tray 20 and the stubs 24 of the print tray 23 are respectively received in the bearings 22 and 25 via annular, slide resistance members 45, which are respectively fitted on the stubs 21 and 24. The slide resistance member 45 fitted on each stub 21 and the slide resistance member 45 fitted on each stub 24 play the role of a first and a second regulating member, respectively. In the illustrative embodiment, each slide resistance member 45 is formed of rubber or similar elastic material having a large coefficient of friction.

There acts between the outer periphery of each slide resistance member 45 and the associated stub 22 or 25 a frictional force that regulates the angular movement of the sheet feed tray 20 or the print tray 23 from the open position effected by its own weight. The frictional force is selected to be weaker than a frictional force acting between the inner periphery of the slide resistance member 45 and the stub 21 or 24. In this configuration, when the operator moves the sheet feed tray 20 or the print tray 23, the tray 20 or 23 angularly moves with the stubs 21 or 25 sliding on the associated bearings 22 or 23.

Figure 7:
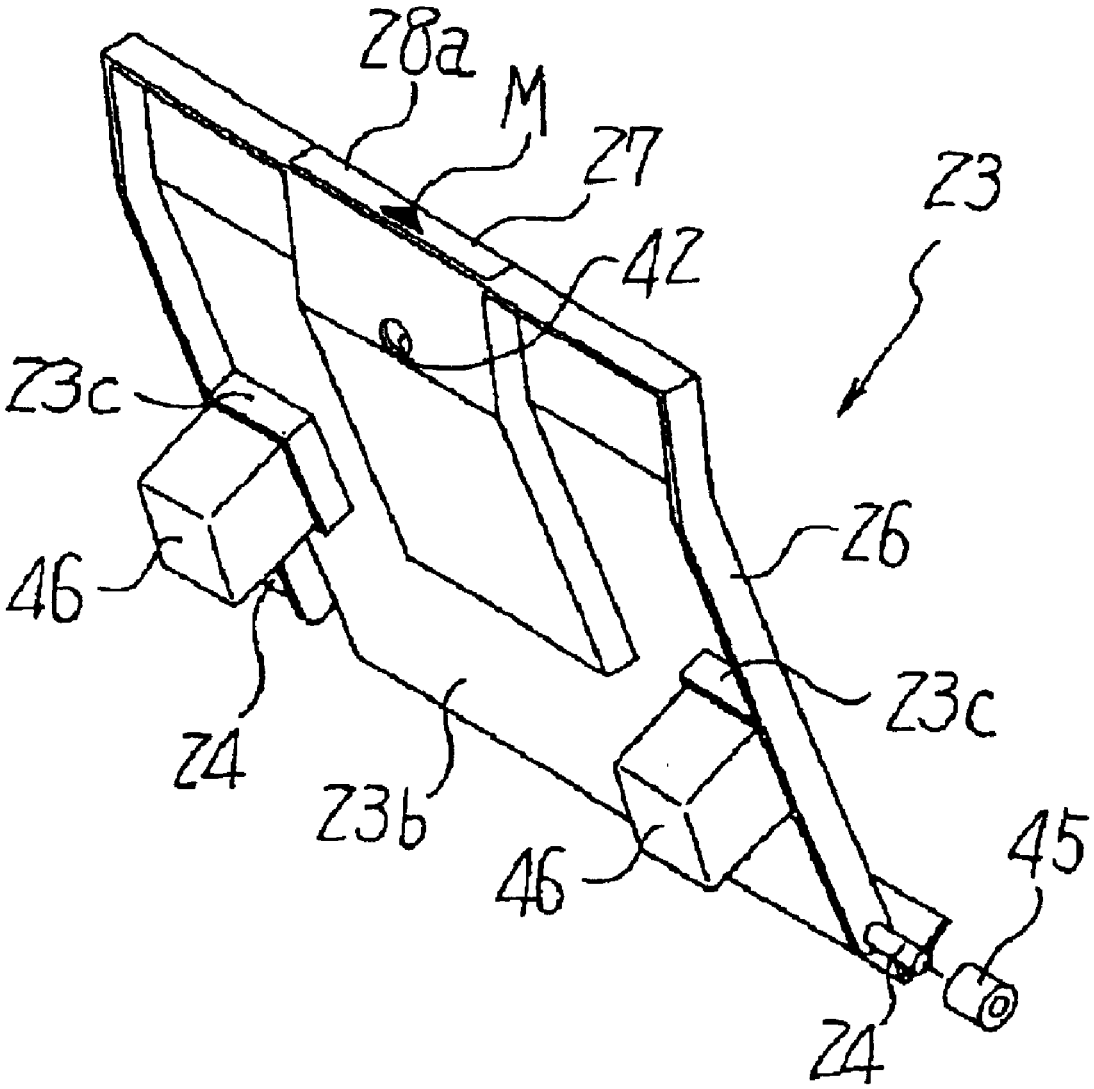
FIG. 7 is an isometric view showing a print tray included in the second embodiment.

FIG. 7 is a view showing the back of the print tray 23. As shown, a pair of support portions 23*c* are formed on the back 23*b* of the print tray 23 opposite to the surface 23*a* and are spaced from each other by a distance equal to or larger than the width of a sheet in the main scanning direction. A pair of spacer members or biasing members 46 respectively protrude from the support portions 23*c* away from the print tray 23. The spacer members 46 therefore face each other at a distance equal to or larger than the width of a sheet in the main scanning direction.

The spacer members 46 each are formed of rubber, sponge, spring or similar elastic material that exerts a reaction force when compressed. The spacers 46 exert, when compressed, a restoring force weaker than the force of the locking mechanism 41 tending to lock the sheet feed tray 20 and print tray 23 in the full-closed positions, but stronger than the frictional force that the slide resistance members 45 on the stubs 21 exert between the stubs 21 and the bearings 22.

In the above configuration, assume that the operator moves the print tray 23 held at the full-closed position in the opening direction together with the sheet feed tray 20. Then, the spacer members 46 released from the locking mechanism 41 urge the sheet feed tray 20 in the opening direction with their restoring force stated above. As soon as the spacer members 46 fully restore their original shape, they stop urging the sheet feed tray 20. Consequently, the sheet feed tray 20 and print tray 23 in their open positions angularly move while being spaced from each other by a distance X, which corresponds to the dimension of each spacer 46 in the compressing direction.

As soon as the force causing the print tray 23 to angularly move is canceled, the print tray 23 stops moving at a position short of the full-open position due to the function of the slide resistance members 45. Also, the sheet feed tray 20 stops moving at a position short of the full-open position at the same time as the print tray 23 stops moving. Even when the sheet feed tray 20 and print tray 23 are held in such open positions short of the full-open positions, the operator can stack sheets on the sheet feed tray 20. The operator therefore does not have to move the trays 20 and 23 to their full-open positions. This further reduces the space to be occupied by the ink jet printer in the event of printing.

Third Embodiment

Figure 8:
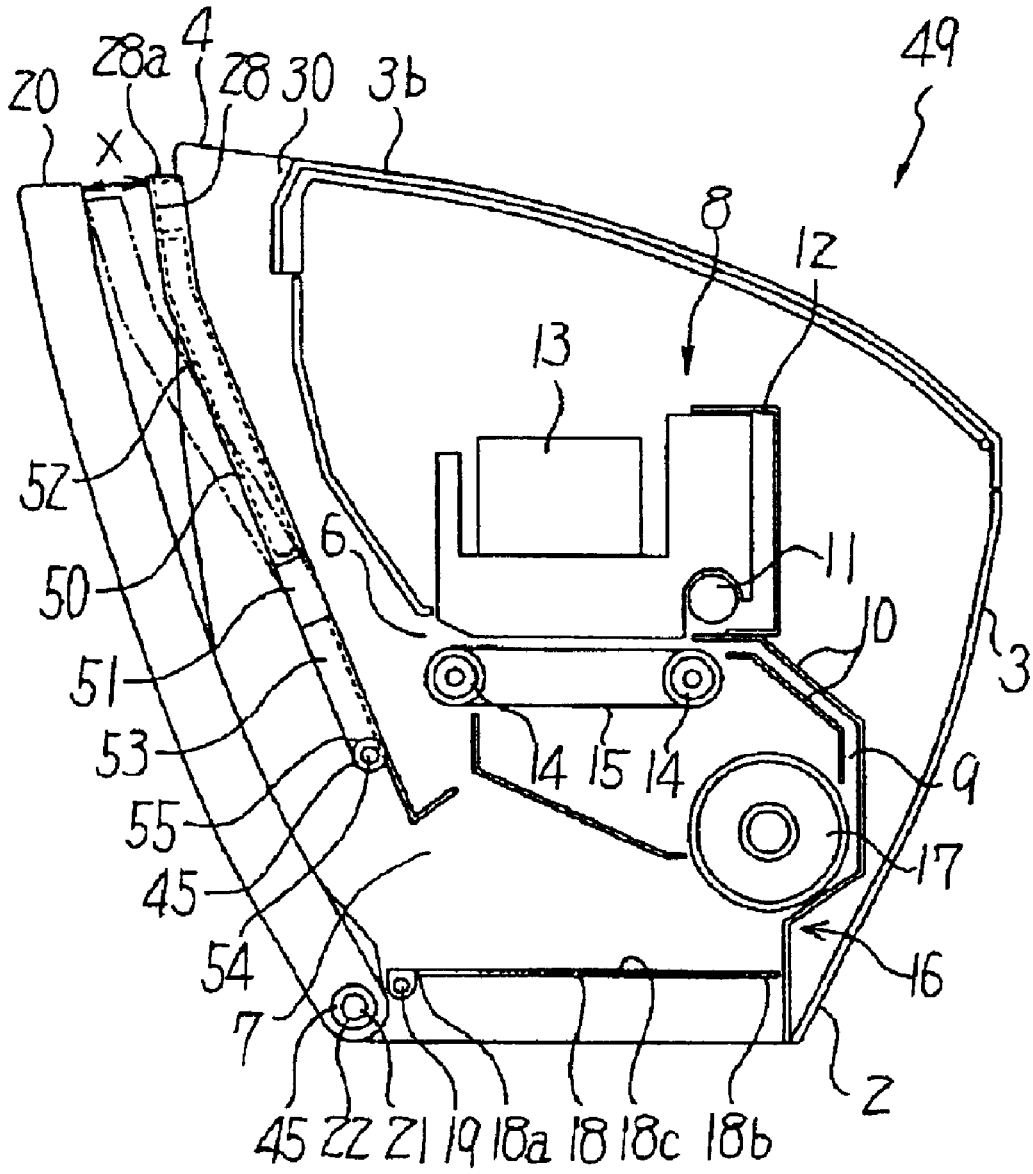
FIG. 8 is a vertical section showing a third embodiment of the present invention.
Figure 9:
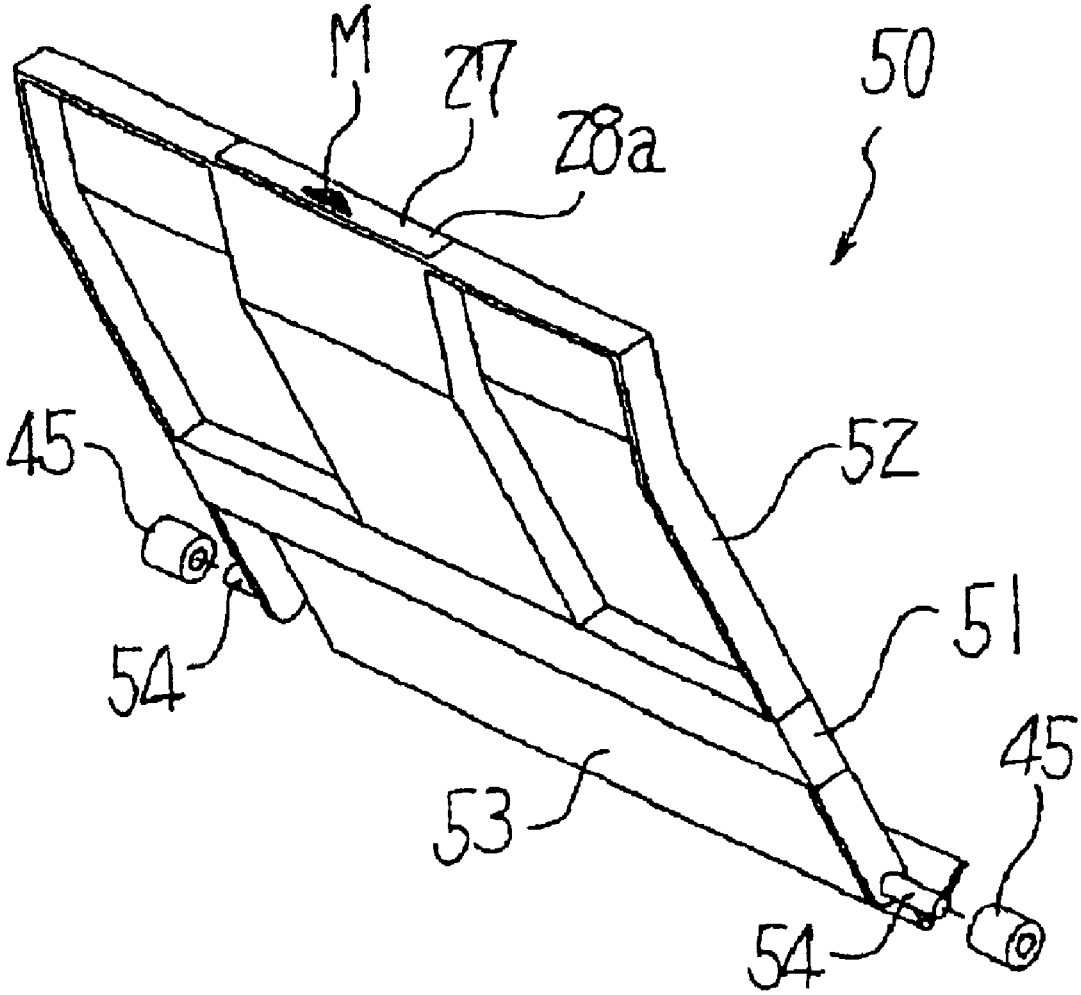
FIG. 9 is an isometric view showing a print tray included in the third embodiment.

A third embodiment of the ink jet printer in accordance with the present invention will be described with reference to FIGS. 8 and 9. As shown, the ink jet printer, generally 49, includes a print tray 50. Stubs 54 protrude from opposite sides of the print tray 50 and are rotatably supported by bearings 55, which are mounted on the housing 2, via slide resistance members 45 fitted on the stubs 54. The print tray 50 is therefore angularly movable about the stubs 54.

The print tray 50 includes two tray parts 52 and 53 connected to each other by a flexible member 51 and adjoining the grip 28 and stubs 54, respectively. The subtray 27 with the grip 28 is mounted on the tray part 52 in such a manner as to be slidable relative to the tray part 52. The flexible member 51 yields when subjected to an external force weaker than a frictional force, which acts between the stubs 54 and the bearings 55 because of the slide resistance bearings 45, or restores its original shape when released from such an external force.

Assume that the operator moves the print tray 50 held in the full-closed position in the opening direction by holding the tray portion 52. Then, the print tray 50 angular moves in the opening direction while deforming the flexible member 51, as indicated by a phantom line in FIG. 8. At the same time, the print tray 50 in movement forces the sheet feed tray 20 in the opening direction.

When the operator stops moving the print gray 50 away from the full-closed position, the print tray 50 stops moving. At this instant, the flexible member 51 returns to its original position due to its own flexibility, as indicated by a solid line in FIG. 8. As a result, the print tray 50 and sheet feed tray 20 are spaced from each other by a distance X corresponding to the displacement of the tray part 52 effected by the restoration of the flexible member 51. The sheet feed tray 20 and print tray 50 can therefore be constantly spaced by the distance X when in their open positions.

Again, the sheet inlet 7 and sheet outlet 6 are accessible even when the sheet feed tray 20 and print tray 23 are held in the open positions short of the full-open positions, so that the operator can stack sheets on the sheet feed tray 20 without fully opening the trays 20 and 23. This minimizes the space to be occupied by the ink jet printer 49 in the event of printing.

Fourth Embodiment

Figure 10B:
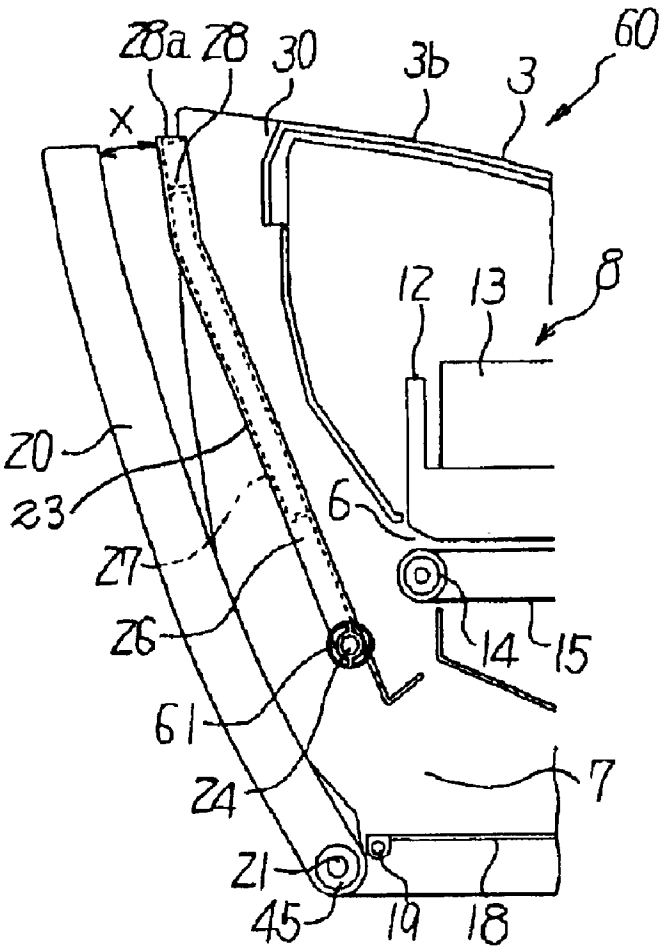
FIGS. 10A and 10B are sectional side elevations showing a fourth embodiment of the present invention.

A fourth embodiment of the ink jet printer in accordance with the present invention will be described with reference to FIGS. 10A and 10B. As shown, the ink jet printer, generally 60, includes a slide bearing member or first regulating member 61 fitted on each stub 24 of the print tray 23. As shown in FIGS. 11A and 11B specifically, the slide bearing member 61 is made up of two rings or annular members 62 and 63 each having a particular diameter and a pair of ribs 64 connecting the rings 62 and 63 in the radial direction. The rings 62 and 63 and ribs 64 are implemented as a molding of rubber or similar elastic material having a large coefficient of friction.

The ring or first annular member 62 has an inside diameter equal to the outside diameter of the stub 24 and is fitted on the stub 24. The other ring or second annular member 63 has an outside diameter equal to the inside diameter of the bearing 25 and is fitted in the bearing 25. The ribs 64, which are elongate in the radial direction, face each other with the intermediary of the stub 24.

A frictional force similar to one exerted by the slide resistance member 45 acts between the outer ring 63 and the bearing 25, regulating the angular movement of the print tray 23 effected by its own weight. More specifically, the slide resistance member 61 has its rings 62 and 63 sized such that a frictional force acting between the outer ring 63 and the bearing 25 is weaker than a frictional force acting between the inner ring 62 and the stub 24. Therefore, when the operator turns the print tray 23, the outer ring 63 and bearing 25 start sliding on each other before the inner ring 62,and stub 24 do so.

Figure 10A:
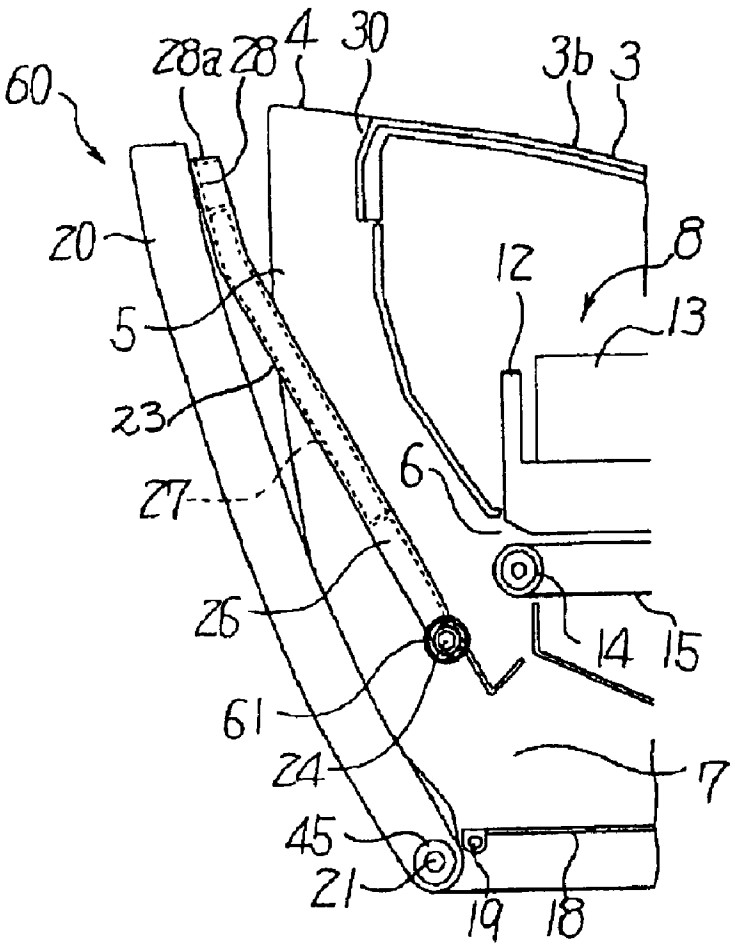
Figure 11A:
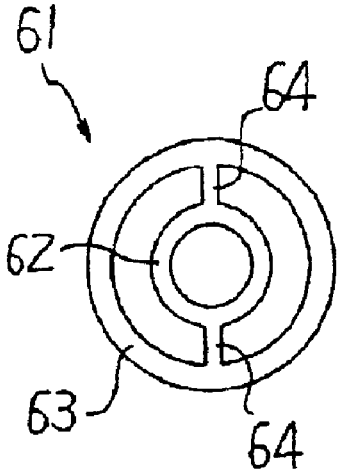
FIGS. 11A and 11B are side elevations showing a slide resistance member included in the fourth embodiment.
Figure 11B:
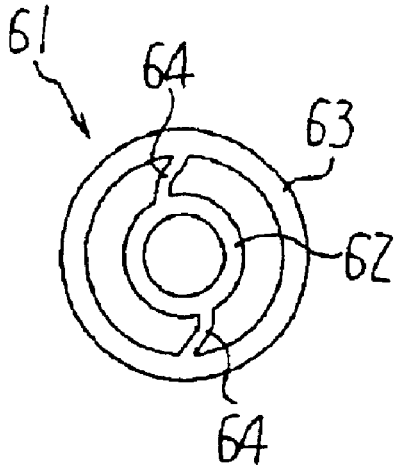

In the above configuration, when the operator moves the print tray 23 in the opening direction, the print tray 23 forces the sheet feed tray 20 in the opening direction, as shown in FIG. 10A. At this instant, the stub 24 of the print tray 23 rotates about its own axis in the opening direction, causing the inner ring 62 fitted thereon to rotate in the same direction.

On the other hand, in the condition shown in FIG. 10A, the outer ring 63 fitted in the bearing 25 tends to obstruct the rotation of the inner ring 62 due to friction acting between the outer ring 63 and the bearing 25. When the print tray 23 is moved in the opening direction, the stub 24 in rotation entrains the inner ring 62 due to friction acting between the inner ring 62 and the stub 24. At this instant, the outer ring 63 tends to remain stationary in the bearing 25 due to the friction mentioned above.

The frictional force acting between the outer ring 63 and the bearing 25 is weaker than the frictional force acting between the inner ring 62 and the stub 24, as stated earlier. Therefore, although the outer ring 63 tends to remain stationary in the bearing 25, it is rotated little by little by being pulled by the inner ring 62 via the ribs 64. At this instant, as shown in FIG. 11B, the rings 62 and 63 pull the ribs 64 with the result that the rings 64 elastically deform in the lengthwise direction.

When the operator stops moving the print tray 23 in the opening direction, the ribs 64 deformed between the rings 62 and 63, as stated above, restore their original position. The restoring force of the ribs 64 causes the print tray 23 to move in the closing direction because of the frictional force acting between the outer ring 63 and the bearing 25 and regulating the movement of the print tray 23. As a result, the print tray 23 and sheet feed tray 20 are spaced from each other by a distance X corresponding to the elastic deformation of the ribs 64.

Fifth Embodiment

Figure 12A:
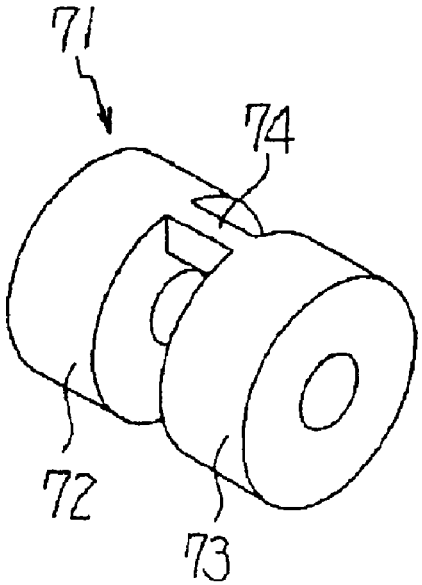
FIGS. 12A and 12B are perspective views showing a slide resistance member representative of a fifth embodiment of the present invention.
Figure 12B:
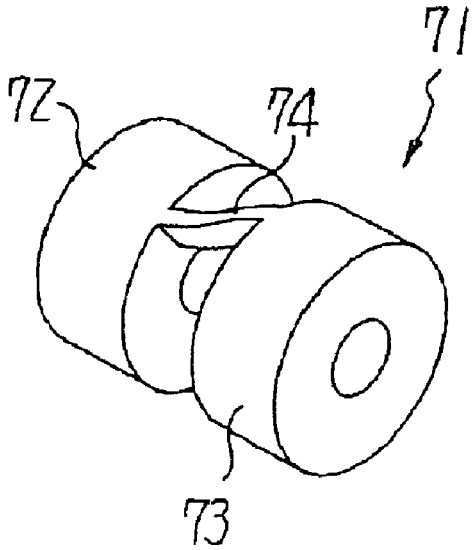

Reference will be made to FIGS. 12A and 12B for describing a fifth embodiment of the ink jet printer in accordance with the present invention. As shown, the illustrative embodiment includes a slide resistance member 71 interposed between each stub 24 of the print tray 23 and the associated bearing 25. The slide resistance member 71 is made up of two rings 72 and 73 having the same diameter and a pair of ribs 74 connecting the rings 72 and 73 in the main scanning direction. The rings 72 and 73 and ribs 74 are implemented as a molding of rubber or similar elastic material having a large coefficient of friction. The ring 72 is fitted on the stub 24 while the other ring 73 is fitted in the bearing 25. The ribs 74 are elongate in the main scanning direction and face each other with the intermediary of the bearing 25.

The slide resistance member 71 causes a frictional force, which regulates the movement of the print tray 23 effected by its own weight, to act between the housing 2 and the print tray 23. In the illustrative embodiment, the slide resistance member 71 is configured such that a frictional force to act between the ring 73 and the bearing 25 is weaker than a frictional force to act between the ring 72 and the stub 24. Therefore, when the operator angularly moves the tray 23, the ring 73 and bearing 25 start sliding on each other before the ring 72 and stub 24 do so.

In the above configuration, when the operator moves the print tray 23 in the opening direction, the ribs 74 elastically deform in such a manner as to be twisted, as shown in FIG. 12B. As soon as the operator stops moving the print tray 23 in the above direction, the ribs 74 restore their original positions with the result that the sheet feed tray 20 and print tray 23 are spaced from each other by the distance X, FIG. 10B.

Sixth Embodiment

Figure 13:
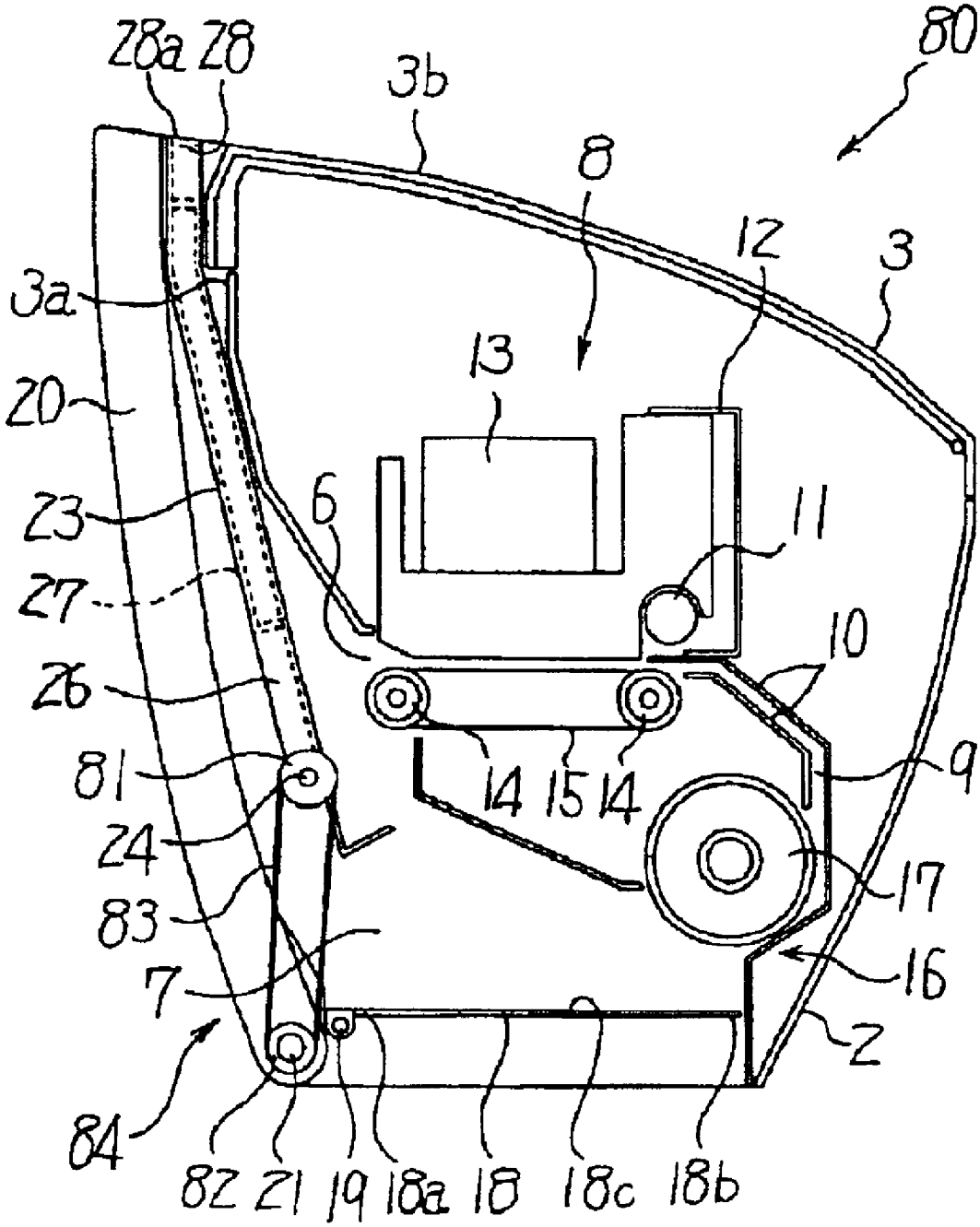
FIG. 13 is a vertical section showing a sixth embodiment of the present invention.

FIG. 13 shows a sixth embodiment of the ink jet printer in accordance with the present invention. As shown, the ink jet printer, generally 80, also includes the print tray 23 with the stubs 24. A first pulley 81 affixed to each stub 24 and is rotatable about the stub 24 in accordance with the movement of the tray 23. Likewise, a second pulley 82 is affixed to each stub 21 of the sheet feed tray 20 and rotatable about the stub 21 in accordance with the movement of the sheet feed tray 20. In the illustrative embodiment, the ratio in diameter of the pulley 81 to the pulley 82 is selected to be 7:6.

A timing belt or endless belt 83 is passed over the first and second pulleys 81 and 82. The pulleys 81 and 82 and timing belt 83 constitute an interlocking mechanism 84.

In the above configuration, when the operator turns the print tray 23 in the opening direction, the pulleys 81 mounted on the stubs 24 of the print tray 23 rotate in the opening direction while causing the timing belt 83 to move. The timing belt 83, in turn, causes the pulleys 82 mounted on the stubs 21 of the sheet feed tray 20 to rotate in the same direction as the pulleys 81. As a result, the sheet feed tray 20 is moved in the opening direction. At this instant, the ratio in opening angle of the print tray 23 to the sheet feed tray is 6:7 because of the ratio in diameter mentioned previously.

The illustrative embodiment therefore allows the print tray 23 and sheet feed tray 20 to move in the opening direction at the same time only if the operator moves the print tray 23 in the opening direction by a single action.

Seventh Embodiment

Figure 14:
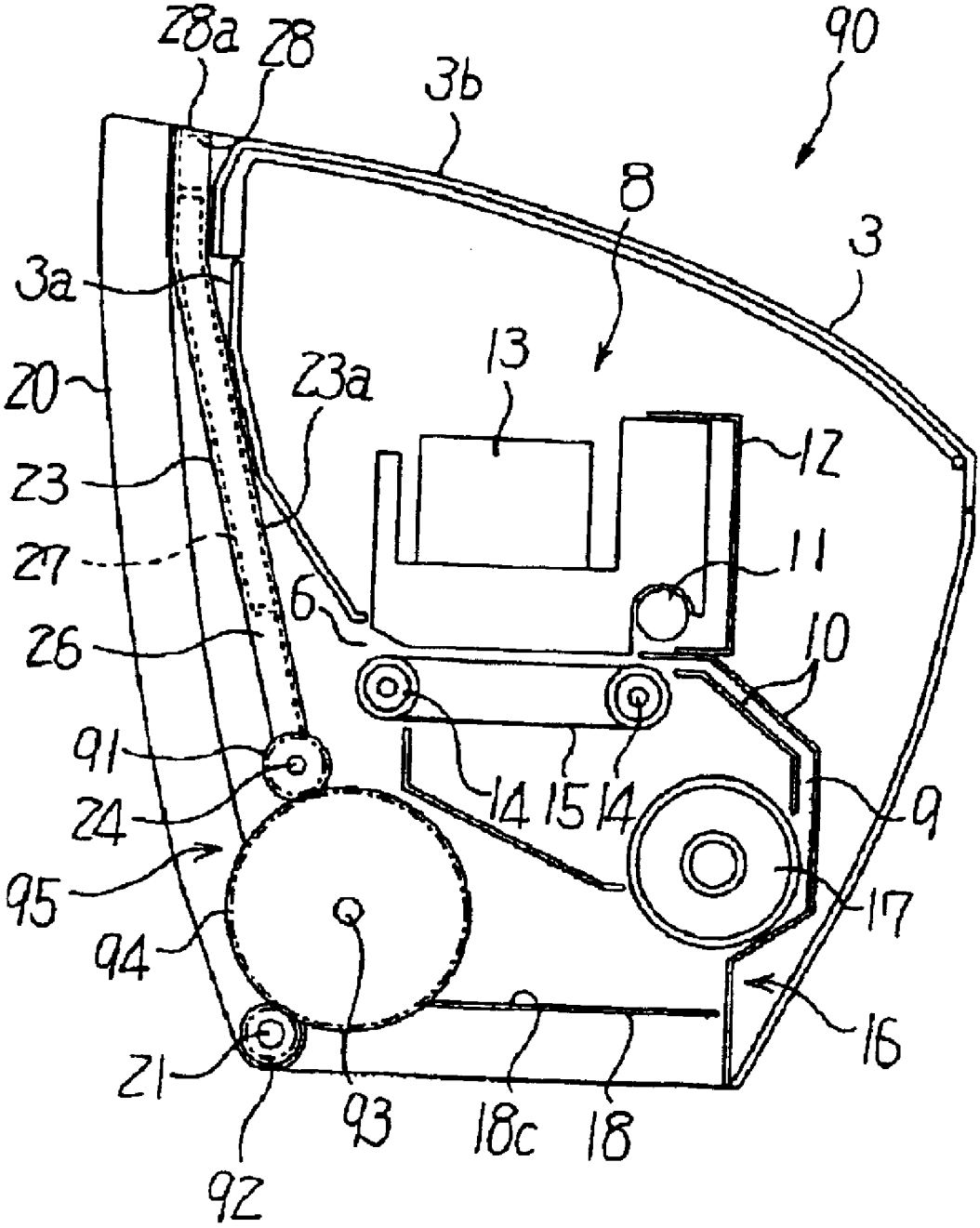
FIG. 14 is a vertical section showing a seventh embodiment of the present invention.

FIG. 14 shows a seventh embodiment of the ink jet printer in accordance with the present invention. As shown, the ink jet printer, generally 90, also includes the print tray 23 with the stubs 24. A first gear 91 is affixed to each stub 24 is rotatable about the stub 24 in accordance with the movement of the tray 23. Likewise, a second gear 92 is affixed to each stub 21 of the sheet feed tray 20 and rotatable about the stub 21 in accordance with the movement of the sheet feed tray 20. An intermediate gear 94 is freely rotatable about a shaft 93 affixed to the housing 2 and is held in mesh with the gears 91 and 92. The gears 91 and 92 and intermediate gear 94 constitute an interlocking mechanism 95

In the above configuration, when the operator turns the print tray 23 in the opening direction, the gears 91 mounted on the stubs 24 of the print tray 23 rotate in the opening direction while causing the intermediate gear 94 to move.

The intermediate gear 94, in turn, causes the gears 92 mounted on the stubs 21 of the sheet feed tray 20 to rotate in the same direction as the gears 91. As a result, the sheet feed tray 20 is moved in the opening direction. In this manner, the sheet inlet 7 and sheet outlet 6 are uncovered.

It is to be noted that the intermediate gear 94, which is representative of a gear train, may be replaced with a plurality of gears so long as the number of gears is odd for causing the gears 91 and 92 to rotate in the same direction.

In summary, it, will be seen that the present invention provides a printer having various unprecedented advantages as enumerated below.

(1) A first and a second opening are uncovered at the same time only if the operator moves a first tray away from a full-closed position. Also, the two openings are covered at the same time only if the operator moves a second tray to a full-closed position. This facilitates the opening and closing of the two openings.

(2) The printer occupies a minimum of space when in operation or out of operation. The printer prevents dust and other impurities from entering in its housing via the two openings when out of operation.

(3) The printer can operate even when the first and second trays are, e.g., half-open, further saving space when in operation. Even in this condition, the two openings are surely uncovered.

(4) The printer has a simple, space-saving configuration.

(5) The first and second trays do not protrude from the housing of the printer and are therefore free from damage.

(6) The first tray is made up of a main tray and a subtray. The subtray prevents prints sequentially stacked on the first tray from dropping despite that the first tray is shorter than the second tray. The operator can move the first tray and then slide the subtray by a single action.

(7) Power supply to the printer can be automatically, selectively set up or interrupted. This not only frees the operator from troublesome work, but also obviates wasteful power consumption.

Various modifications will become possible for those skilled in the art after receiving the teachings of the present disclosure without departing from the scope thereof.

What is claimed is:

1. A printer comprising:

a housing including an upright wall;

a first opening formed in said upright wall and elongate in a horizontal direction;

a first tray positioned below said first opening and angularly movable about a first shaft, which has an axis extending in a lengthwise direction of said first opening, between a full-closed position for covering said first opening and an open position for uncovering said first opening;

a second opening formed in said upright wall below said first opening and elongate in the horizontal direction;

a second tray positioned below said second opening and angularly movable about a second shaft, which has an axis extending in a widthwise direction of said second opening, between a full-closed position for covering said second opening while overlapping said first tray and an open position for uncovering said second opening;

a sheet path providing communication between said first opening and said second opening via a printer section arranged in said housing; and a conveying mechanism for conveying a recording medium along said sheet path.

2. The printer as claimed in claim 1, further comprising:

a first regulating member configured to regulate an angular movement of said first tray effected by a weight of said first tray; and a second regulating member configured to regulate an angular movement of said second tray effected by a weight of said second tray.

3. The printer as claimed in claim 2, wherein said first regulating member and said second regulating member each are interposed between said first shaft or said second shaft and a first bearing or a second bearing supporting said first shaft of said second shaft, and said first regulating member and said second regulating member each are formed of an elastic material exerting a frictional force that regulates the angular movement of said first tray or said second tray.

4. The printer as claimed in claim 2, further comprising:

a locking mechanism for locking said first tray and said second tray at the full-closed positions; and a biasing member constantly configured to bias said first tray and said second tray away from each other with a force stronger than a locking force of said locking mechanism, but weaker than a regulating force of said second regulating member acting on said second tray.

5. The printer as claimed in claim 2, wherein said first tray comprises:

a first tray part angularly movable about said first shaft;

a second tray remote from said first shaft; and a flexible member connecting said first tray part and said second tray part and yielding when subjected to a force weaker than a regulating force of said first regulating member.

6. The printer as claimed in claim 2, wherein said first regulating member comprises:

a first annular member fitted on said first shaft;

a second annular member surrounding said first annular member; and connecting members connecting said first annular member and said second annular member.

7. The printer as claimed in claim 2, wherein said first regulating member comprises:

a first annular member fitted on said first shaft;

a second annular member coaxial with said first annular member; and connecting members connecting said first annular member and said second annular member in an axial direction of said first shaft;

said first regulating member being affixed to said first tray.

8. The printer as claimed in claim 2, further comprising:

an interlocking mechanism interlocking said first shaft and said second shaft such that said first tray and said second tray move in a same direction as each other.

9. The printer as claimed in claim 8, wherein said interlocking mechanism comprises:

a first pulley rotatable about said first shaft in accordance with a movement of said first tray;

a second pulley rotatable about said second shaft in accordance with a movement of said second tray; and an endless belt passed over said first pulley and said second pulley.

10. The printer as claimed in claim 8, wherein said interlocking mechanism comprises:

a first gear rotatable about said first shaft in accordance with a movement of said first tray;

a second gear rotatable about said second shaft in accordance with a movement of said second tray; and a gear train connecting said first gear and said second gear.

11. The printer as claimed in claim 8, further comprising a hollow recessed from a surface of said housing by a thickness of said first tray and a thickness of said second tray, whereby said first tray and said second tray are received in said hollow without protruding from said housing.

12. The printer as claimed in claim 2, further comprising a grip positioned on said first tray at a side opposite to said first shaft.

13. The printer as claimed in claim 12, wherein said grip is painted in a color different from a color around said grip.

14. The printer as claimed in claim 12, wherein a mark indicative of a position of said grip is provided on said first tray.

15. The printer as claimed in claim 12, wherein said first tray comprises:

a main tray movable about said first tray; and a subtray slidable away from said first shaft relative to said main tray, said grip being positioned on said subtray.

16. The printer as claimed in claim 2, further comprising:

deciding means for determining whether or not said first tray is held at the full-closed position; and power shutting means for interrupting power supply when said deciding means determines that said first tray is held at the full-closed position.

17. The printer as claimed in claim 16, further comprising a sensor mounted on said upright wall and varying an output thereof in accordance with whether or not said first tray is held at the full-closed position, said deciding means making a decision in accordance with the output of said sensor.

18. The printer as claimed in claim 2, further comprising:

deciding means for determining whether or not said first tray is held at the full-closed position; and power feeding means for setting up power supply when said deciding means determines that said first tray is not held at the full-closed position.

19. The printer as claimed in claim 18, further comprising a sensor mounted on said upright wall and varying an output thereof in accordance with whether or not said first tray is held at the full-closed position, said deciding means making a decision in accordance with the output of said sensor.

20. The printer as claimed in claim 1, further comprising a hollow recessed from a surface of said housing by a thickness of said first tray and a thickness of said second tray, whereby said first tray and said second tray are received in said hollow without protruding from said housing.

21. The printer as claimed in claim 1, further comprising a grip positioned on said first tray at a side opposite to said first shaft.

22. The printer as claimed in claim 20, wherein said grip is painted in a color different from a color around said grip.

23. The printer as claimed in claim 20, wherein a mark indicative of a position of said grip is provided on said first tray.

24. The printer as claimed in claim 20, wherein said first tray comprises:

a main tray movable about said first tray; and a subtray slidable away from said first shaft relative to said main tray, said grip being positioned on said subtray.

25. The printer as claimed in claim 20, further comprising:

deciding means for determining whether or not said first tray is held at the full-closed position; and power shutting means for interrupting power supply when said deciding means determines that said first tray is held at the full-closed position.

26. The printer as claimed in claim 25, further comprising a sensor mounted on said upright wall and varying an output thereof in accordance with whether or not said first tray is held at the full-closed position, said deciding means making a decision in accordance with the output of said sensor.

27. The printer as claimed in claim 20, further comprising:

deciding means for determining whether or not said first tray is held at the full-closed position; and power feeding means for setting up power supply when said deciding means determines that said first tray is not held at the full-closed position.

28. The printer as claimed in claim 27, further comprising a sensor mounted on said upright wall and varying an output thereof in accordance with whether or not said first tray is held at the full-closed position, said deciding means making a decision in accordance with the output of said sensor.

29. The printer as claimed in claim 1, further comprising a grip positioned on said first tray at a side opposite to said first shaft.

30. The printer as claimed in claim 29, wherein said grip is painted in a color different from a color around said grip.

31. The printer as claimed in claim 29, wherein a mark indicative of a position of said grip is provided on said first tray.

32. The printer as claimed in claim 29, wherein said first tray comprises:

a main tray movable about said first tray; and a subtray slidable away from said first shaft relative to said main tray, said grip being positioned on said subtray.

33. The printer as claimed in claim 29, further comprising:

deciding means for determining whether or not said first tray is held at the full-closed position; and power shutting means for interrupting power supply when said deciding means determines that said first tray is held at the full-closed position.

34. The printer as claimed in claim 33, further comprising a sensor mounted on said upright wall and varying an output thereof in accordance with whether or not said first tray is held at the full-closed position, said deciding means making a decision in accordance with the output of said sensor.

35. The printer as claimed in claim 29, further comprising:

deciding means for determining whether or not said first tray is held at the full-closed position; and power feeding means for setting up power supply when said deciding means determines that said first tray is not held at the full-closed position.

36. The printer as claimed in claim 35, further comprising a sensor mounted on said upright wall and varying an output thereof in accordance with whether or not said first tray is held at the full-closed position, said deciding means making a decision in accordance with the output of said sensor.

37. The printer as claimed in claim 1, further comprising:

deciding means for determining whether or not said first tray is held at the full-closed position; and power shutting means for interrupting power supply when said deciding means determines that said first tray is held at the full-closed position.

38. The printer as claimed in claim 37, further comprising a sensor mounted on said upright wall and varying an output thereof in accordance with whether or not said first tray is held at the full-closed position, said deciding means making a decision in accordance with the output of said sensor.

39. The printer as claimed in claim 1, further comprising:

deciding means for determining whether or not said first tray is held at the full-closed position; and power feeding means for setting up power supply when said deciding means determines that said first tray is not held at the full-closed position.

40. The printer as claimed in claim 39, further comprising a sensor mounted on said upright wall and varying an output thereof in accordance with whether or not said first tray is held at the full-closed position, said deciding means making a decision in accordance with the output of said sensor.

* * * * *